US010059107B2

(12) United States Patent
Akahane et al.

(10) Patent No.: US 10,059,107 B2
(45) Date of Patent: Aug. 28, 2018

(54) LIQUID EJECTING HEAD, LIQUID EJECTING APPARATUS, AND MANUFACTURING METHOD OF LIQUID EJECTING HEAD

(71) Applicant: SEIKO EPSON CORPORATION, Tokyo (JP)

(72) Inventors: Fujio Akahane, Azumino (JP); Hiroaki Okui, Azumino (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 15/187,404

(22) Filed: Jun. 20, 2016

(65) Prior Publication Data

US 2016/0297202 A1 Oct. 13, 2016

Related U.S. Application Data

(63) Continuation of application No. 14/566,535, filed on Dec. 10, 2014, now Pat. No. 9,393,786.

(30) Foreign Application Priority Data

Dec. 24, 2013 (JP) ..... 2013-265370

(51) Int. Cl.
*B41J 2/16* (2006.01)
*B41J 2/14* (2006.01)
*B41J 2/155* (2006.01)

(52) U.S. Cl.
CPC ..... *B41J 2/161* (2013.01); *B41J 2/14233* (2013.01); *B41J 2/155* (2013.01); *B41J 2/1623* (2013.01);
(Continued)

(58) Field of Classification Search
CPC . B41J 2/161; B41J 2/155; B41J 2/1623; B41J 2/14233; B41J 2/1626; B41J 2/1632; B41J 2002/14362; B41J 2202/21; B41J 2202/22; B41J 2202/03; B41J 2002/14241; B41J 2002/14491; B41J 2202/19; B41J 2202/20; B41J 2002/14419; Y10T 29/49401
See application file for complete search history.

(56) References Cited

U.S. PATENT DOCUMENTS 5,565,900 A 10/1996 Cowger et al.
7,413,284 B2 8/2008 Higginson et al.
(Continued)

FOREIGN PATENT DOCUMENTS

JP 07-251505 10/1995
JP 11-147314 A 6/1999
(Continued)

*Primary Examiner* — Justin Seo
(74) *Attorney, Agent, or Firm* — Workman Nydegger

(57) ABSTRACT

Provided is a liquid ejecting head including a fixing plate which includes a first surface and a second surface on a side opposite to the first surface, a plurality of head units which are fixed to the second surface such that the head units can eject liquid to the first surface side of the fixing plate, and a case member which includes a wall portion that is formed to surround the head units and fixed to the fixing plate and which has a plurality of protrusion portions formed in a part of the wall portion, which is the portion facing the fixing plate.

19 Claims, 12 Drawing Sheets

(52) U.S. Cl.
CPC ..... *B41J 2/1626* (2013.01); *B41J 2/1632* (2013.01); *B41J 2002/14241* (2013.01); *B41J 2002/14362* (2013.01); *B41J 2002/14419* (2013.01); *B41J 2002/14491* (2013.01); *B41J 2202/03* (2013.01); *B41J 2202/19* (2013.01); *B41J 2202/20* (2013.01); *B41J 2202/21* (2013.01); *B41J 2202/22* (2013.01); *Y10T 29/49401* (2015.01)

(56) References Cited

U.S. PATENT DOCUMENTS

| | | | |
|---|---|---|---|
| 7,665,815 | B2 | 2/2010 | Swett et al. |
| 2002/0024568 | A1 | 2/2002 | Ito et al. |
| 2004/0165028 | A1 | 8/2004 | Ito et al. |
| 2005/0116995 | A1 | 6/2005 | Tanikawa et al. |
| 2005/0206678 | A1 | 9/2005 | Nishino |
| 2006/0119637 | A1 | 6/2006 | Berry et al. |
| 2007/0165077 | A1 | 7/2007 | Tanikawa et al. |
| 2008/0211867 | A1 | 9/2008 | Komura |
| 2009/0058935 | A1 | 3/2009 | Owaki et al. |
| 2009/0225137 | A1 | 9/2009 | Fujishiro |
| 2013/0147882 | A1 | 6/2013 | Okui et al. |
| 2014/0292953 | A1* | 10/2014 | Kinoshita ..... B41J 2/175 347/85 |
| 2015/0174901 | A1 | 6/2015 | Akahane et al. |

FOREIGN PATENT DOCUMENTS

| | | | |
|---|---|---|---|
| JP | 2002-144590 | A | 5/2002 |
| JP | 2005-131947 | | 5/2005 |
| JP | 2005131948 | A | 5/2005 |
| JP | 2005-297554 | | 10/2005 |
| JP | 2009-056658 | A | 3/2009 |
| JP | 2012-061785 | A | 3/2012 |
| JP | 2013-123802 | A | 6/2013 |
| JP | 2013-147007 | A | 8/2013 |
| JP | 2013202857 | A | 10/2013 |

* cited by examiner

LIQUID EJECTING HEAD, LIQUID EJECTING APPARATUS, AND MANUFACTURING METHOD OF LIQUID EJECTING HEAD

This application is a continuation application of U.S. patent application Ser. No. 14/566,535, filed Dec. 10, 2014, which patent application is incorporated herein by reference in its entirety. U.S. patent application Ser. No. 14/566,535 claims the benefit of and priority to Japanese Patent Application No. 2013-265370, filed Dec. 24, 2013, the contents of which are hereby incorporated by reference in its entirety.

BACKGROUND

1. Technical Field

The present invention relates to a technology for ejecting liquid, such as ink.

2. Related Art

Hitherto, a liquid ejecting head having a configuration in which a plurality of head units that eject liquid, such as ink, through a plurality of nozzles are arranged has been proposed. A configuration in which printing heads are respectively fixed, via a flexible circuit, to inner sides of a plurality of concave portions formed in a plate-shaped supporting body has been disclosed in JP-A-7-251505. A configuration in which a plurality of recording heads are fixed, using a screw, to a plate-shaped module base has been disclosed in JP-A-2005-297554. In addition, a configuration in which a nozzle sheet is bonded to a surface of a plate-shaped frame module having a plurality of opening portions formed therein and head chips are fixed to the nozzle sheet via respective opening portions of the frame module has been disclosed in JP-A-2005-131947.

When the flatness of a plate material having a plurality of head units installed therein is low, in terms of technologies of JP-A-7-251505, JP-A-2005-297554, and JP-A-2005-131947, the distance (hereinafter, referred to as an "ejection distance") between the respective nozzles of the head unit and a printing medium, such as a printing paper sheet, is different for each head unit. As a result, there is a problem in that the printing quality is reduced. Since, in the technology of JP-A-7-251505, the printing head is fixed, via the flexible circuit, to the inner side of the concave portion of the supporting body, a difference in the ejection distance for each printing head can be apparent. The technology of JP-A-2005-297554 has a problem in that the module base is likely to be deformed (in other words, to be reduced in flatness) by the stress due to the screw for fixing each recording head to the module base. The technology of JP-A-2005-131947 has a problem in that the nozzle sheet in which the plurality of head chips are installed is likely to be deformed because the frame module and the nozzle sheet are subjected to thermocompression bonding such that the frame module pulls the nozzle sheet. Furthermore, there is a problem in that the manufacturing costs are high because the frame module is formed of an alumina ceramic.

When a plurality of head units are installed in a plate material formed of a material having high flatness and rigidity, there is room for a reduction in differences in an ejection distance for each head unit. However, the plate material formed of a material having high flatness and rigidity is likely to be high in manufacturing costs.

SUMMARY

An advantage of some aspects of the invention is to highly flatten a member having a plurality of head units installed therein, with low costs.

According to an aspect of the invention, there is provided a liquid ejecting head including a fixing plate which includes a first surface and a second surface on a side opposite to the first surface, a plurality of head units which are fixed to the second surface such that the head units can eject liquid to the first surface side of the fixing plate, and a case member which includes a wall portion formed to surround the head units and fixed to the fixing plate and which has a plurality of protrusion portions that is formed in a part of the wall portion, which is the portion facing the fixing plate. In this case, the plurality of head units are fixed to the second surface of the fixing plate and the plurality of protrusion portions are formed in a part of the wall portion of the case member, which is the portion facing the fixing plate. It is easy to uniformize the heights of the plurality of protrusion portions, compared to uniformizing the height over the entire wall portion. Thus the fixing plate is flattened by fixing the wall portion having the plurality of protrusion portions formed therein. Accordingly, there is an advantage in that the fixing plate can be highly flattened while suppressing the manufacturing costs.

In the liquid ejecting head, it is preferable that the plurality of head units and the wall portion of the case member be fixed to the fixing plate using an adhesive. In this case, since the plurality of head units and the case member are fixed, using an adhesive, to the fixing plate, the effect that the fixing plate is flattened is especially remarkable, compared to the configuration in which each head unit and the case member are fixed, using a tool, such as a screw, to the fixing plate.

In the liquid ejecting head, it is preferable that the case member include a facing portion which is located on a side opposite to the fixing plate, in a state where the plurality of head units are interposed therebetween. In addition, it is preferable that a gap between the fixing plate and the facing portion be greater than the height of the head unit from the second surface. In this case, since the gap between the fixing plate and the facing portion is greater than the height of the head unit, there is an advantage in that, even when error is caused in the height of the head unit, the case member can be easily fixed to the fixing plate.

In the liquid ejecting head, it is preferable that the case member be integrally molded using a resin material. In this case, since the case member is integrally molded using a resin material, there is an advantage in that the case member in which the plurality of protrusion portions having highly uniformized heights are formed can be formed with low manufacturing costs, compared to the configuration in which components of the case member are separately formed.

In the liquid ejecting head, it is preferable that the fixing plate be formed of stainless steel. In this case, since the fixing plate is formed of stainless steel, there is an advantage in that the fixing plate having high flatness can be formed with low manufacturing costs. In the configuration in which the head unit includes a substrate formed of silicon, SUS430 stainless steel is preferred as a material of the fixing plate. Since SUS430 stainless steel has a low linear expansion coefficient (similar to that of silicon), there is an advantage in that the thermal stress due to the difference between the linear expansion coefficients of the silicon substrate of the head unit and the fixing plate is reduced.

In the liquid ejecting head, it is preferable that the fixing plate be a plate-shaped member or a plate-shaped member having an obtuse bending angle. In this case, the deformation of the fixing plate is suppressed, compared to the configuration in which a part of the fixing plate is bent in a state where the bending angle is, for example, an acute angle. Accordingly, the effect that the fixing plate is highly flattened is especially remarkable.

In the liquid ejecting head, it is preferable that an opening portion through which liquid ejected from the head unit passes be formed in the fixing plate. In addition, it is preferable that the opening portion be formed by performing punching or etching on a plate material. In this case, since the opening portion of the fixing plate is formed by performing punching or etching on the plate material, there is an advantage in that the fixing plate can be formed while suppressing the deformation (in other words, a reduction in the flatness) of the plate material, compared to the case where the opening portion is formed by, for example, cutting the plate material.

In the liquid ejecting head, it is preferable that the head unit include a portion protruding from the second surface to the first surface side. In addition, it is preferable that the height of the portion protruding to the first surface side, relative to the second surface, be less than the thickness of the fixing plate. In this case, since the height of a part of the head unit, which is the portion protruding from the second surface to the first surface side, is less than the thickness of the fixing plate, it is possible to fix the plurality of head units to the fixing plate, while maintaining the state where the fixing plate is mounted on a flat surface of, for example, a surface plate. Accordingly, the effect that the fixing plate is flattened is especially remarkable.

In the liquid ejecting head, it is preferable that the case member be fixed to the head unit. In addition, it is preferable that a part of the head unit, which is a portion in contact with the case member, and the case member have substantially the same linear expansion coefficients. In this case, since the head unit and the case member have substantially the same linear expansion coefficients, there is an advantage in that the thermal stress due to the difference between the linear expansion coefficients of the head unit and the case member can be reduced.

In the liquid ejecting head, it is preferable that the plurality of head units be sealed by a single cap in contact with the first surface of the fixing plate. In this case, since the plurality of head units are sealed by the single cap in contact with the first surface of the fixing plate, the configuration is simplified, compared to the configuration in which a cap is separately mounted for each head unit. Furthermore, since the fixing plate of the invention is highly flattened, as described above, there is an advantage in that the plurality of head units can be effectively sealed, regardless of the configuration in which the single cap is mounted for the plurality of head units.

According to another aspect of the invention, there is provided a liquid ejecting apparatus which includes the liquid ejecting head according to the aspects described above. A preferred example of the liquid ejecting head is a printing apparatus in which ink is ejected. However, the use of the liquid ejecting apparatus according to the invention is not limited to printing.

According to still another aspect of the invention, there is provided a manufacturing method of a liquid ejecting head including a fixing plate which includes a first surface and a second surface on a side opposite to the first surface, a plurality of head units which eject liquid, and a case member which includes a wall portion having a plurality of protrusion portions formed thereon. The method includes fixing the plurality of head units to the second surface, in a state where the fixing plate is mounted on a surface plate, such that liquid can be ejected onto the first surface side of the fixing plate, and fixing the case member to the fixing plate, while maintaining the state where the fixing plate is mounted on the surface plate, such that the wall portion surrounds the head units and the plurality of protrusion portions are in contact with the second surface of the fixing plate. In this case, since fixing the plurality of head units to the second surface of the fixing plate and fixing the case member to the fixing plate are performed in a state where the fixing plate is mounted on the surface plate, there is an advantage in that the fixing plate can be highly flattened.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
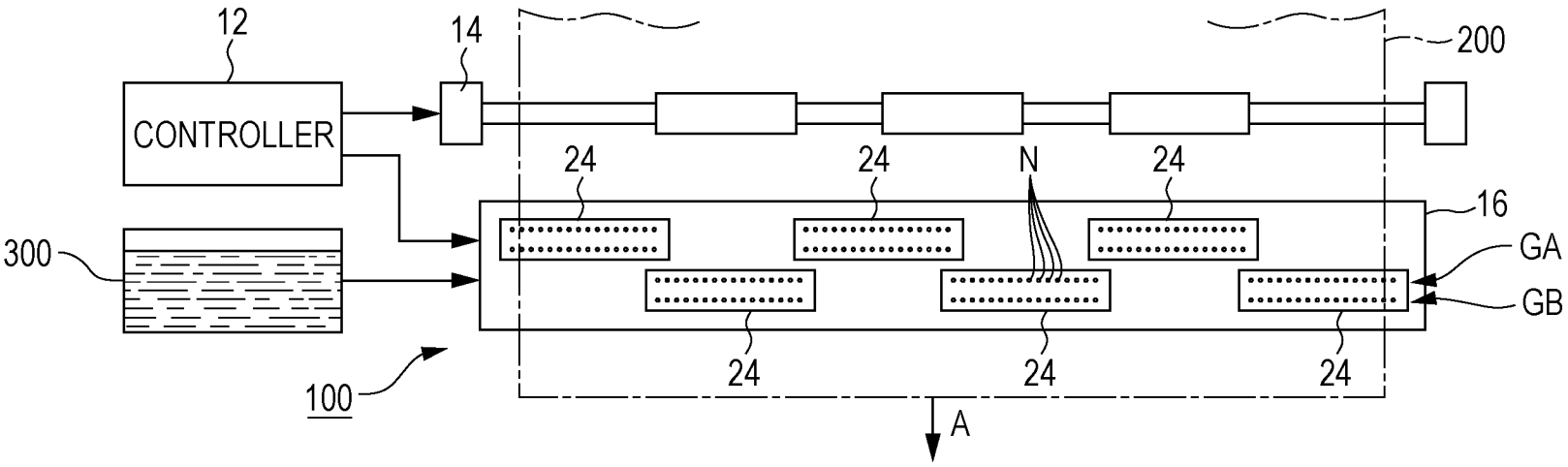
FIG. 1 is a configuration view of a printing apparatus according to Embodiment 1 of the invention.

FIG. 1 is a partial configuration view of an ink jet type printing apparatus 100 according to Embodiment 1 of the invention. The printing apparatus 100 of Embodiment 1 is a liquid ejecting apparatus which ejects ink as an example of liquid onto a printing medium 200, such as a printing paper sheet. The printing apparatus 100 includes a controller 12, a transporting mechanism 14, and a liquid ejecting head 16. The controller 12 generally controls elements of the printing apparatus 100. The transporting mechanism 14 transports the printing medium 200 in a predetermined direction A, in accordance with the control by the controller 12. An ink cartridge 300 filled with ink is mounted on the printing apparatus 100. The liquid ejecting head 16 of FIG. 1 is a line head which ejects the ink supplied from the ink cartridge 300 onto the printing medium 200 through a plurality of nozzles N, in accordance with the control by the controller 12.

Figure 2:
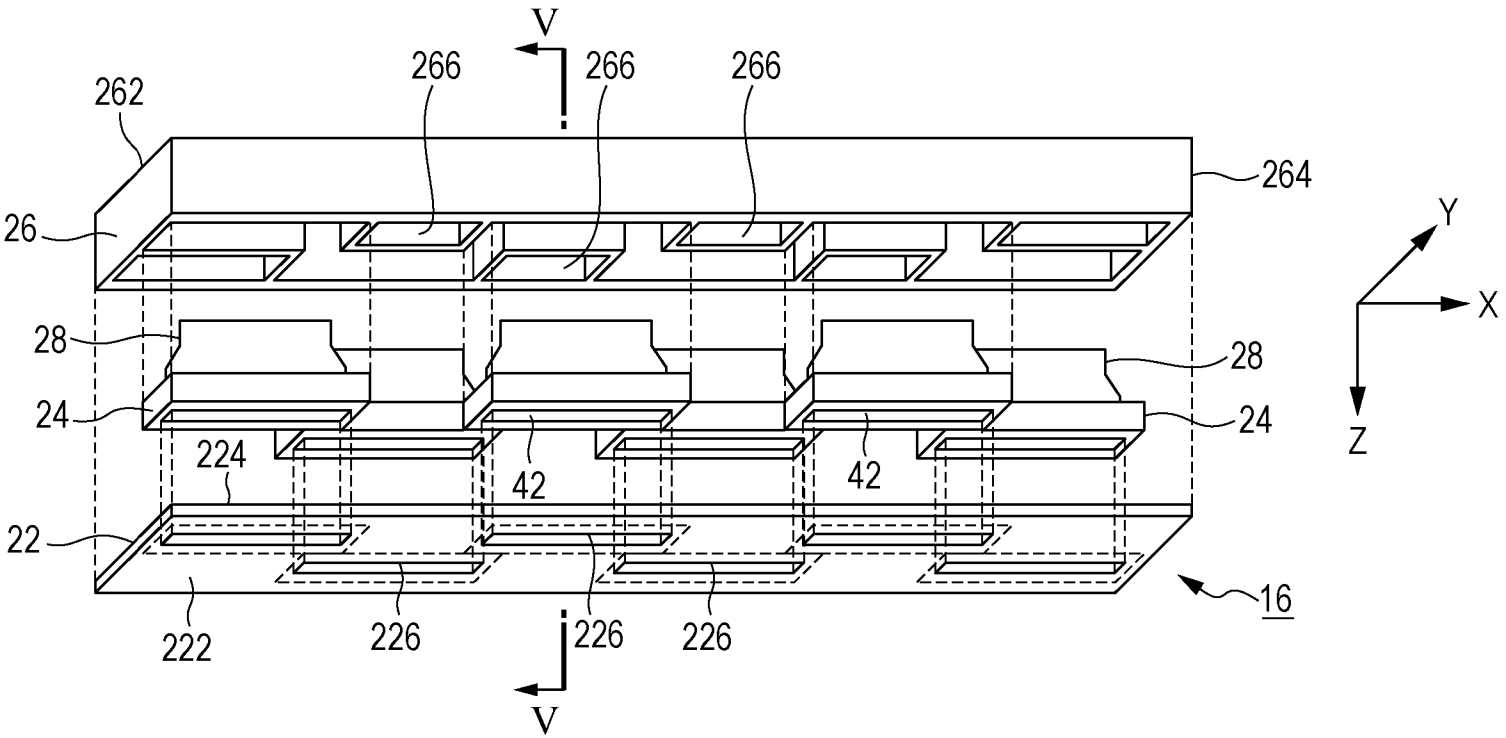
FIG. 2 is an exploded perspective view of a liquid ejecting head.

FIG. 2 is an exploded perspective view of the liquid ejecting head 16. The liquid ejecting head 16 of Embodiment 1 includes a fixing plate 22, a plurality of head units 24, and a case member 26, as illustrated in FIG. 2. Schematically, the plurality of head units 24 are accommodated and supported in a space formed by the fixing plate 22 and the case member 26.

The fixing plate 22 is a plate-shaped member having a first surface 222 and a second surface 224 on a side opposite to the first surface 222. Any material is used as the material of the fixing plate 22. However, a plate material formed of a metal having high hardness is suitable as the fixing plate 22. Specifically, the fixing plate 22 of Embodiment 1 is formed of stainless steel. Stainless steel, such as SUS430 or SUS304, is suitable as the material of the fixing plate 22. However, from the viewpoint of suppressing the thermal deformation of the fixing plate 22, SUS430 having a relatively low linear expansion coefficient is particularly suitable as the material of the fixing plate 22. A suitable size (for example, 80 μm) is selected in the range of, for example, 50 μm to 1000 μm, as the thickness of the fixing plate 22. Since the fixing plate 22 of Embodiment 1 is formed of stainless steel, as described above, it is possible to reduce manufacturing costs, compared to in a case where the fixing plate 22 is formed of a material, such as an alumina ceramic.

In the following description, an X-Y plane parallel to the first surface 222 (or the second surface 224) of the fixing plate 22 is supposed and a direction perpendicular to the first surface 222 will be referred to as a Z direction. In the fixing plate 22, the first surface 222 is located on a positive side in the Z direction and the second surface 224 is located on a negative side in the Z direction. The liquid ejecting head 16 is installed in a state where the first surface 222 of the fixing plate 22 faces the printing medium 200 (that is, the Z direction is directed to a lower side in a vertical direction). Accordingly, the X-Y plane corresponds to a plane (horizontal plane) substantially parallel to the printing medium 200. When seen in a plan view (that is, seen in the Z direction), the fixing plate 22 of Embodiment 1 is formed in a rectangular shape extending in an X direction, as can be understood from FIG. 2. A Y direction is a direction (which is a lateral direction of the fixing plate 22) perpendicular to both the X direction and the Z direction.

The plurality of head units 24 are head chips which eject ink through the plurality of nozzles N. The head units 24 are fixed to the second surface 224 of the fixing plate 22, which is a surface located on the negative side in the Z direction. The plurality of head units 24 of Embodiment 1 are arranged in first and second columns of which the positions are different in the Y direction. The X-directional positions of the head units 24 in the first column are different from those in the second column. In other words, the plurality of head units 24 of Embodiment 1 are arranged in a staggered manner.

Figure 3:
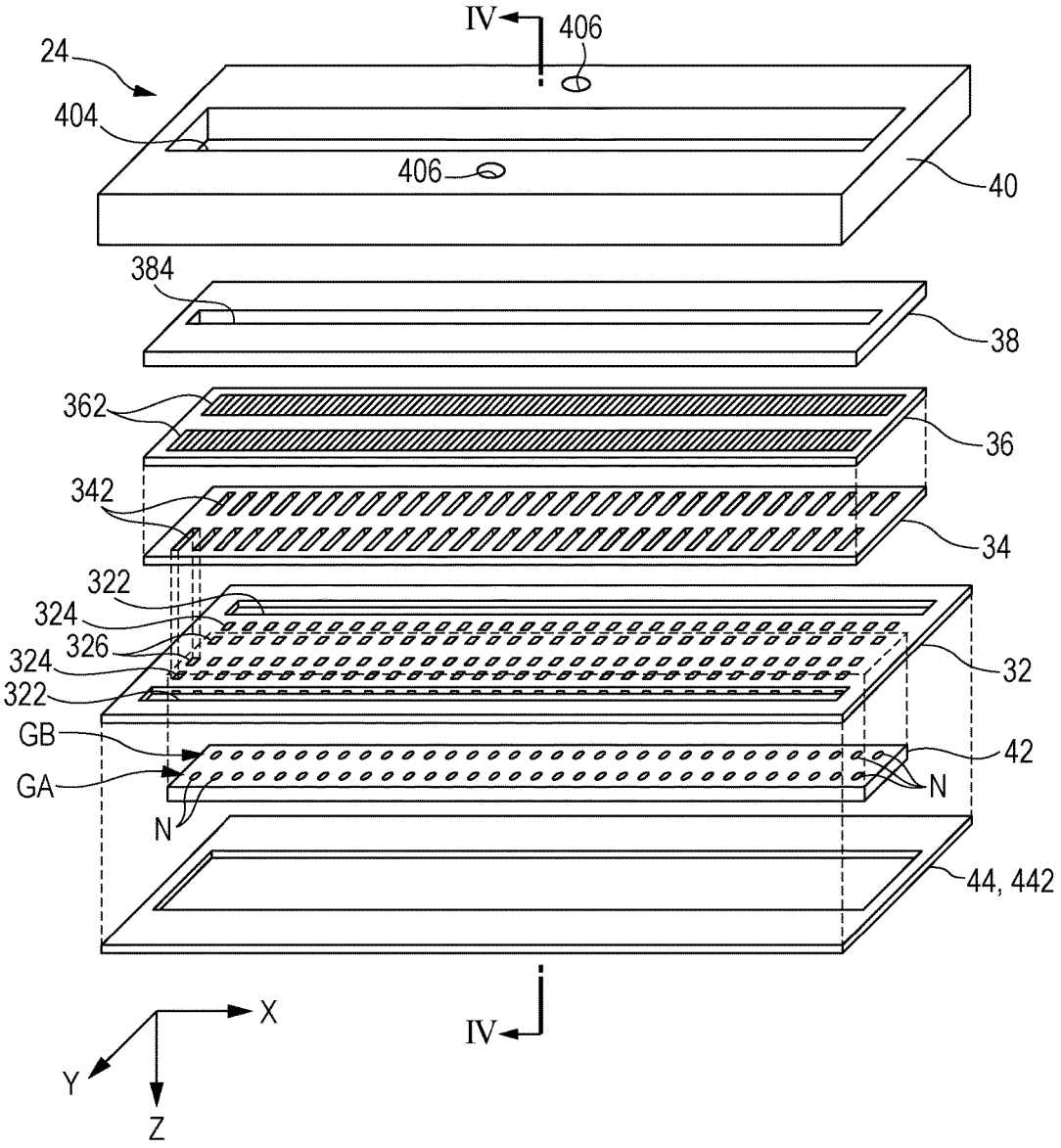
FIG. 3 is an exploded perspective view of a head unit.
Figure 4:
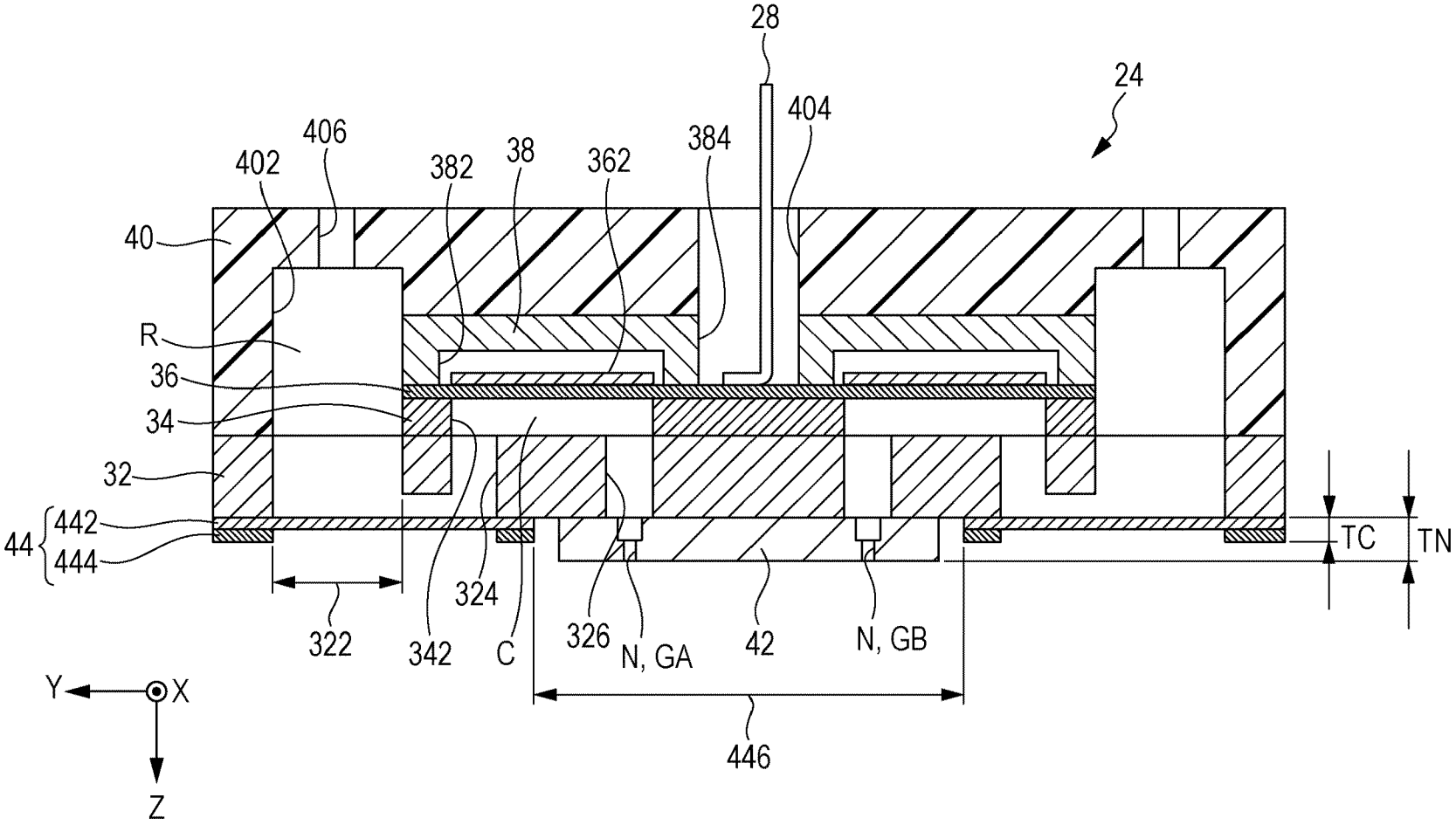
FIG. 4 is a cross-sectional view (which is a cross-sectional view taken along line IV-IV in FIG. 3) of the head unit.

FIG. 3 is an exploded perspective view of one of the head units 24 of the liquid ejecting head 16. FIG. 4 is a cross-sectional (parallel to a Y-Z plane) view taken along line IV-IV in FIG. 3. The head unit 24 of Embodiment 1 is a structure body in which a pressure chamber forming plate 34, a diaphragm 36, a protection plate 38, and a casing body 40 are laminated, in this order, on a surface of a flow-path forming plate 32, which is the surface on the negative side in the Z direction, and a nozzle plate 42 and a compliance substrate 44 overlap on a surface of the flow-path forming plate 32, which is the surface on the positive side in the Z direction, as illustrated in FIG. 3. Schematically, respective elements of the head unit 24 are members having a substantially plate shape extending in the X direction. The elements are connected using, for example, an adhesive.

The nozzle plate 42 is a plate-shaped member on which the plurality of nozzles (ejection ports) N arranged in the X direction are formed. Each of the nozzles N is a through-hole through which the ink passes, as illustrated in FIGS. 3 and 4. Any material and manufacturing method can be applied to the nozzle plate 42. However, it is possible to simply form the nozzle plate 42 having a desired shape, with high accuracy, in such a manner that, for example, a silicon (Si) single crystal substrate is partially removed using a semiconductor manufacturing technology, such as photolithography or etching.

The plurality of nozzles N are divided into a nozzle column GA and a nozzle column GB. Each of the nozzle column GA and the nozzle column GB is a group constituted by the plurality of nozzles N arranged in the X direction. The nozzles N of a plurality of head units 24 are distributed over a range greater than the lateral width (which is the size in a direction perpendicular to a direction A) of the printing medium 200, as can be understood from FIG. 1. An image is printed onto the printing medium 200, in such a manner that the printing medium 200 is transported by the transporting mechanism 14 and the ink is ejected onto the printing medium 200 through each nozzle N of the head units 24. In the head unit 24, the structure corresponding to the nozzle column GA and the structure corresponding to the nozzle column GB are substantially-symmetrically formed, as can be understood from FIG. 4, and both structures are practically the same. Accordingly, in the following description, the focus is placed on elements corresponding to the nozzle column GA and the descriptions relative to elements corresponding to the nozzle column GB will not be repeated.

The flow-path forming plate 32 is a plate-shaped member for forming an ink flow path. An opening portion 322, a plurality of supply flow paths 324 and a plurality of communication flow paths 326 are formed in the flow-path forming plate 32 of Embodiment 1. The supply flow path 324 and the communication flow path 326 are through-holes formed for each nozzle N. The opening portion 322 is a common through-hole (opening) with respect to the plurality of nozzles N. Each supply flow path 324 communicates with the opening portion 322. Any material and manufacturing method can be applied to the flow-path forming plate 32. However, it is possible to simply form the flow-path forming plate 32 having the shape exemplified above, with high accuracy, in such a manner that, for example, a silicon single crystal substrate is partially removed using a semiconductor manufacturing technology.

The compliance substrate 44 has a sealing plate 442 and a supporting body 444, as illustrated in FIG. 4. The sealing plate 442 is a sheet-shaped (film-shaped) member having flexibility. The supporting body 444 fixes the sealing plate 442 to the flow-path forming plate 32 such that the opening portion 322 and the supply flow path 324 of the flow-path forming plate 32 are closed. The supporting body 444 is formed of stainless steel (for example, SUS430), similarly to the fixing plate 22. An opening portion 446 extending in the X direction is formed in the compliance substrate 44 (the sealing plate 442). The nozzle plate 42 is fixed to the surface of the flow-path forming plate 32, in the inner side of the opening portion 446. A thickness TN of the nozzle plate 42 is greater than a thickness TC (the sum of the thicknesses of both the sealing plate 442 and the supporting body 444) of the compliance substrate 44, as can be understood from FIG. 4 (TN>TC). Therefore, the surface of the nozzle plate 42 protrudes further to the positive side in the Z direction than the surface of the compliance substrate 44.

The casing body 40 is fixed to the flow-path forming plate 32, as illustrated in FIG. 4. Any material and manufacturing method can be applied to the casing body 40. The casing body 40 is molded to have a single body, in such a manner that, for example, resin material (plastic) is subjected to injection molding. A concave portion 402, a slit 404, and a liquid flow path 406 are formed in the casing body 40 of Embodiment 1. The concave portion 402 is a recessed portion having an external shape corresponding to the opening portion 322 of the flow-path forming plate 32, when seen in a plan view. The liquid flow path 406 is a flow path communicating with the concave portion 402. A space in which the opening portion 322 of the flow-path forming plate 32 communicates with the concave portion 402 of the casing body 40 functions as a liquid storage chamber R (reservoir), as can be understood from FIG. 4. the ink supplied through the liquid flow path 406 is stored in the liquid storage chamber R. The compliance substrate 44 (sealing plate 442) constitutes a wall surface (bottom surface) of the liquid storage chamber R and absorbs changes in the pressure of the ink in the liquid storage chamber R, as can be understood from the above description.

The pressure chamber forming plate 34 is installed on a surface of the flow-path forming plate 32, which is the surface on the negative side in the Z direction. A plurality of opening portions 342 corresponding to different nozzles N are formed in the pressure chamber forming plate 34, as illustrated in FIGS. 3 and 4. Any material and manufacturing method can be applied to the pressure chamber forming plate 34. However, it is possible to form the pressure chamber forming plate 34 in such a manner that a silicon single crystal substrate is partially removed using a semiconductor manufacturing technology, similarly to, for example, the flow-path forming plate 32 described above.

The diaphragm 36 is installed in a surface of the pressure chamber forming plate 34, which is the surface on a side opposite to the flow-path forming plate 32. The diaphragm 36 is a plate-shaped member which can elastically oscillate. The diaphragm 36 and the flow-path forming plate 32 face each other with a gap interposed therebetween, in the inner side of each opening portion 342 formed in the pressure chamber forming plate 34, as can be understood from FIG. 4. A space which is interposed between the flow-path forming plate 32 and the diaphragm 36, in the inner side of the opening portion 342 of the pressure chamber forming plate 34, functions as a pressure chamber C (cavity) applying pressure to the ink. Each supply flow path 324 of the flow-path forming plate 32 causes the liquid storage chamber R to communicate with the pressure chamber C. Each communication flow path 326 of the flow-path forming plate 32 causes the pressure chamber C to communicate with the nozzle N. The ink stored in the liquid storage chamber R is branched along the plurality of supply flow paths 324 and supplied to the respective pressure chambers C in parallel and then, the ink is ejected from the respective pressure chambers C to the outside through both the communication flow paths 326 and the nozzles N, as can be understood from the above description.

A plurality of piezoelectric elements 362 corresponding to the different nozzles N (pressure chambers C) are formed in a surface of the diaphragm 36, which is the surface on the side opposite to the pressure chamber forming plate 34. Each piezoelectric element 362 is a laminated body in which a piezoelectric body is interposed between electrodes facing each other. The respective piezoelectric elements 362 separately oscillate, by receiving driving signals. The protection plate 38 is an element for protecting the respective piezoelectric elements 362. The protection plate 38 is fixed to the surface of the pressure chamber forming plate 34 (the diaphragm 36), using, for example, an adhesive. The respective piezoelectric elements 362 are accommodated in a concave portion 382 formed on a surface of the protection plate 38, which is the surface on the diaphragm 36 side.

The wiring substrate 28 is installed in each head unit 24. Specifically, an end portion of the wiring substrate 28 is fixed to a surface of the diaphragm 36, which is the surface on a side opposite to the pressure chamber forming plate 34, as illustrated in FIG. 4. The wiring substrate 28 passes through both a slit 384 formed in the protection plate 38 and the slit 404 formed in the casing body 40 and reaches the external portion. Each piezoelectric element 362 oscillates in accordance with a driving signal which is supplied from the controller 12 through the wiring substrate 28. The diaphragm 36 oscillates in conjunction with the piezoelectric element 362, and thus the pressure of the ink in the pressure chamber C is changed. As a result, the ink is ejected through the nozzles N. The piezoelectric element 362 functions as a pressure generation element which causes the ink in the pressure chamber C to be ejected through the nozzles N in such a manner that the piezoelectric element 362 causes the pressure in the pressure chamber C to be changed, as can be understood from the above description. The configuration of the head units 24 of Embodiment 1 is described above.

Figure 5:
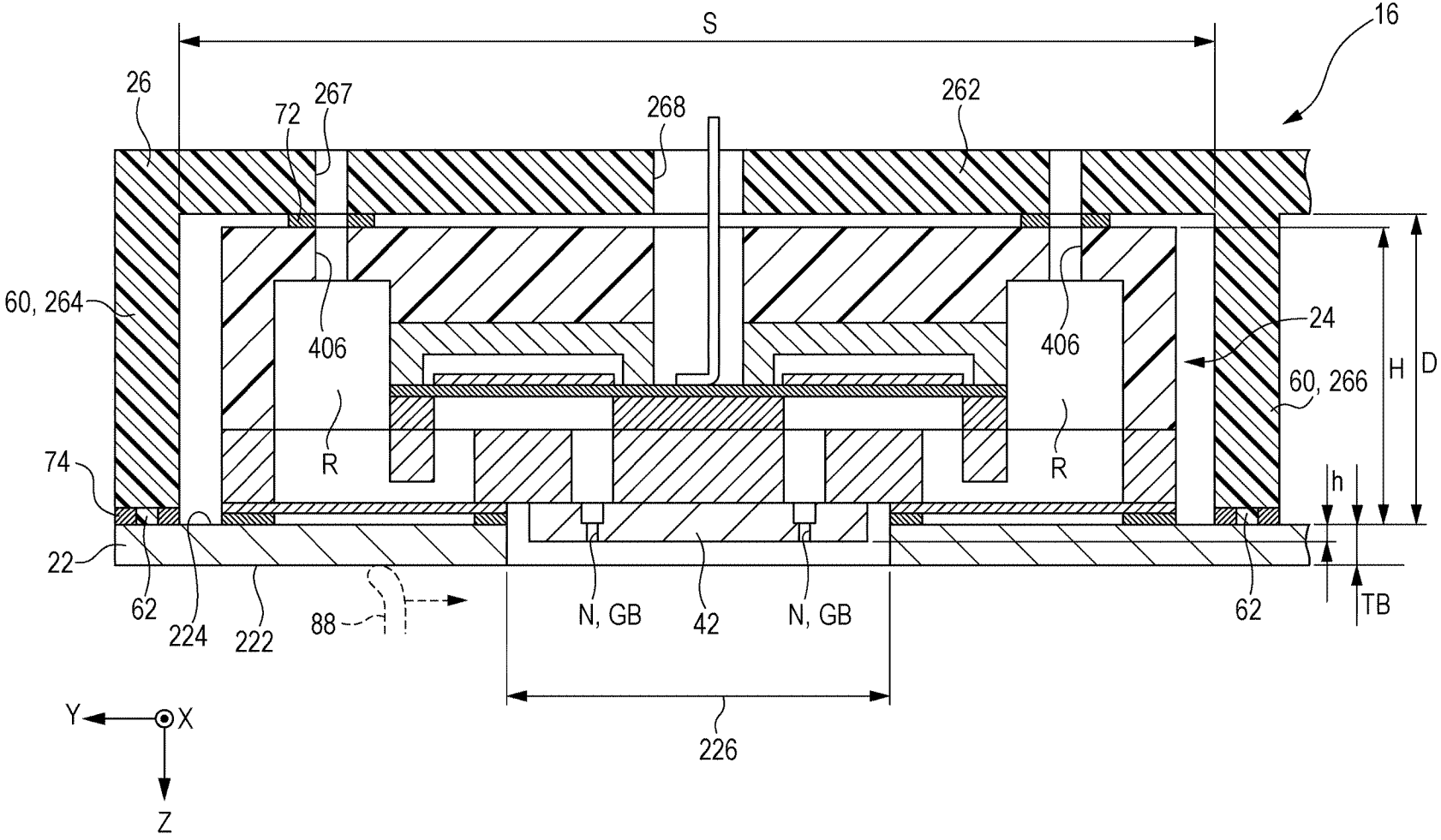
FIG. 5 is a cross-sectional view (which is a cross-sectional view take along line V-V in FIG. 2) of the liquid ejecting head.

FIG. 5 is a cross-sectional view of the liquid ejecting head 16 and corresponds to a cross sectional view taken along line V-V in FIG. 2. The plurality of head units 24 having a structure described above are fixed to the second surface 224 of the fixing plate 22, as illustrated in FIGS. 2 and 5. An opening portion 226 having a shape (a rectangular shape extending in the X direction) corresponding to the nozzle plate 42 of each head unit 24 is formed in the fixing plate 22, for each head unit 24. Each head unit 24 is fixed to the second surface 224 of the fixing plate 22, in a state where the nozzle plate 42 is located in the inner side of the opening portion 226, as illustrated in FIGS. 2 and 5. Each head unit 24 is fixed to the second surface 224 of the fixing plate 22, using, for example, an adhesive. Specifically, the surface of the supporting body 444 of the compliance substrate 44 is bonded to the second surface 224, using an adhesive. The ink ejected through the respective nozzles N of the head unit 24 passes through the opening portion 226 of the fixing plate 22 and proceeds to the positive side in the Z direction, as can be understood from the above description.

When the head unit 24 is fixed to the second surface 224 of the fixing plate 22, the nozzle plate 42 protrudes to the first surface 222 side, relative to the second surface 224, as can be understood from FIG. 5. A height h of a part of the nozzle plate 42, which is a portion protruding from the second surface 224 to the first surface 222 side, is less than a thickness TB of the fixing plate 22 (h<TB). In other words, it is possible to say that the sum of the thickness TC of the compliance substrate 44 and the thickness TB of the fixing plate 22 is greater than the thickness TN of the nozzle plate 42 (TC+TB>TN). Accordingly, the surface of the nozzle plate 42 of Embodiment 1 is located on the second surface 224 side, relative to the first surface 222 of the fixing plate 22. That is, the surface of the nozzle plate 42 is recessed with respect to the first surface 222.

Figure 6:
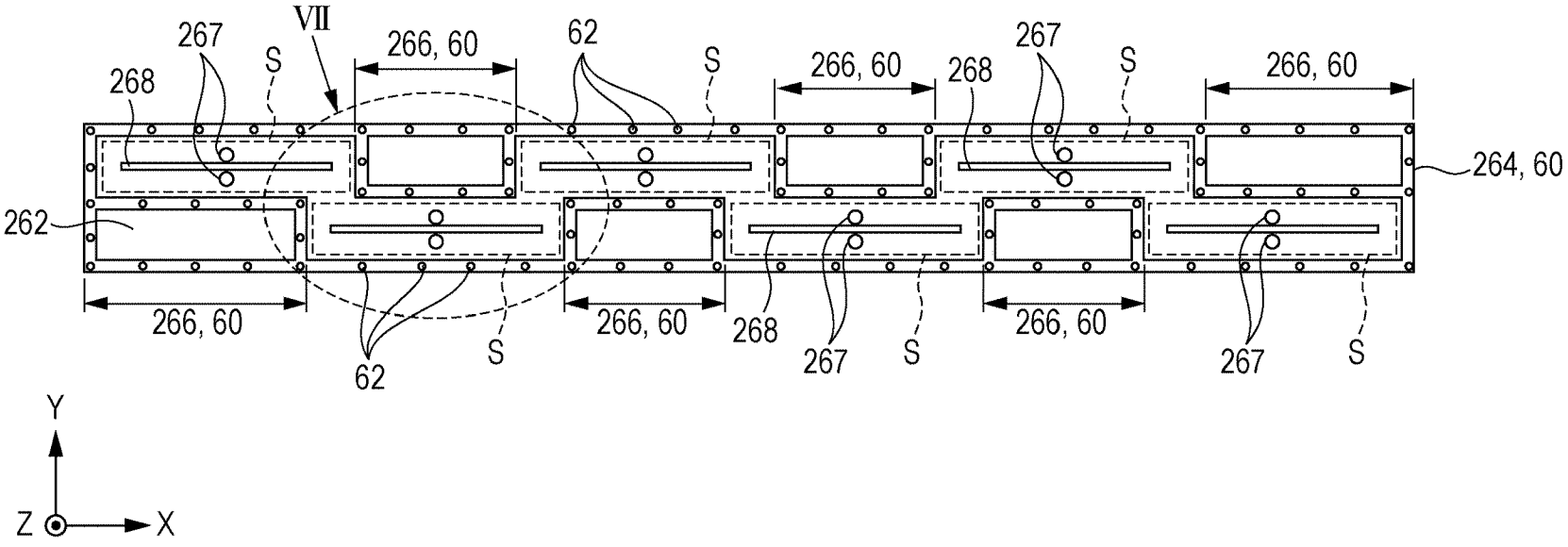
FIG. 6 is a plan view of a case member.

The case member 26 in FIG. 2 is a hollow structure body which accommodates and supports the plurality of head units 24. FIG. 6 is a plan view of the case member 26, when viewed from the fixing plate 22 side (the positive side in the Z direction). The case member 26 of Embodiment 1 is configured to have a facing portion 262, a frame-shaped portion 264, and a plurality of partitioning portions 266, as illustrated in FIGS. 2 and 6. The facing portion 262, the frame-shaped portion 264, and the plurality of partitioning portions 266 are molded to have a single body, in such a manner that, for example, resin material (plastic) is subjected to injection molding. However, the material and the manufacturing method of the case member 26 are not limited to the example described above.

The facing portion 262 is a portion having a plate shape extending in the X direction. The facing portion 262 faces the second surface 224 of the fixing plate 22, with a predetermined gap D interposed therebetween, as illustrated in FIG. 5. In other words, the facing portion 262 is located on a side opposite to the fixing plate 22, in a state where the plurality of the head units 24 are interposed therebetween. The frame-shaped portion 264 is a portion protruding from the circumferential edge of the facing portion 262 to the positive side in the Z direction, as illustrated in FIGS. 2 and 6. The frame-shaped portion 264 is formed in a rectangular frame shape extending in the X direction, when viewed in a plan view, such that the frame-shaped portion 264 corresponds to the external shape of the fixing plate 22. Each of the plurality of partitioning portions 266 is formed in the inner circumferential surface of the frame-shaped portion 264 and is located between adjacent head units 24 in the X direction. The partitioning portions 266 are formed to be spaced apart from each other.

Each head unit 24 is accommodated in a space (hereinafter, referred to as an "accommodation space") S which is partitioned by both the frame-shaped portion 264 and each partitioning portion 266, as illustrated in FIGS. 5 and 6. In other words, both the frame-shaped portion 264 and each partitioning portion 266 function as a wall portion 60 which is formed to surround the head unit 24, in a plan view. In other words, it is possible to say that the wall portion 60 (which is the frame-shaped portion 264 and the partitioning portion 266) is a portion facing the lateral surface of each head unit 24. Although FIG. 5 exemplifies a state where the wall portion 60 and the lateral surface of the head unit 24 face each other with a gap interposed therebetween, it is also possible that the wall portion 60 is in contact with the lateral surface of the head unit 24.

In the wall portion 60 including both the frame-shaped portion 264 and each partitioning portion 266, an end surface (which is the end surface on a side opposite to the facing portion 262) on the fixing plate 22 side is fixed to the second surface 224 of the fixing plate 22, as illustrated in FIG. 5. Specifically, the end surface of the frame-shaped portion 264 having a rectangular frame shape is fixed to the second surface 224 over the whole circumference of the fixing plate 22. In addition, an end surface of each partitioning portion 266 is fixed to the second surface 224 of the fixing plate 22, in the inner side of the frame-shaped portion 264. An adhesive 74, for example, is preferably used for bonding the fixing plate 22 and the case member 26. Specifically, The fixing plate 22 and the case member 26 are bonded via the adhesive 74 applied to the end surface of the wall portion 60 of the case member 26.

A plurality (two) of liquid flow paths 267 and a slit 268 are formed in the facing portion 262, for each accommodation space S (that is, for each head unit 24), as illustrated in FIG. 5. The liquid flow path 267 is a flow path through which the ink supplied from the ink cartridge 300 flows. The slit 268 is a through-hole extending in the X direction. The head unit 24 and the case member 26 are fixed in a state where the liquid flow path 406 of the casing body 40 of each head unit 24 communicates with the liquid flow path 267 of the facing portion 262, as illustrated in FIG. 5. An adhesive 72 is used for bonding the head unit 24 and the case member 26. Specifically, the head unit 24 and the case member 26 are bonded via the adhesive 72 applied to a part of the surface of the casing body 40, which is an area in the vicinity of the circumferential edge of the liquid flow path 406.

The casing body 40 of the head unit 24 in Embodiment 1 and the case member 26 are formed from materials (for example, resin materials of the same type) of which the linear expansion coefficients are practically the same. In other words, the casing body 40 and the case member 26 are substantially the same in the degree of thermal deformation. Accordingly, Embodiment 1 has an advantage in that the thermal stress due to the difference between the linear expansion coefficients of the casing body 40 and the case member 26 is reduced.

Figure 7:
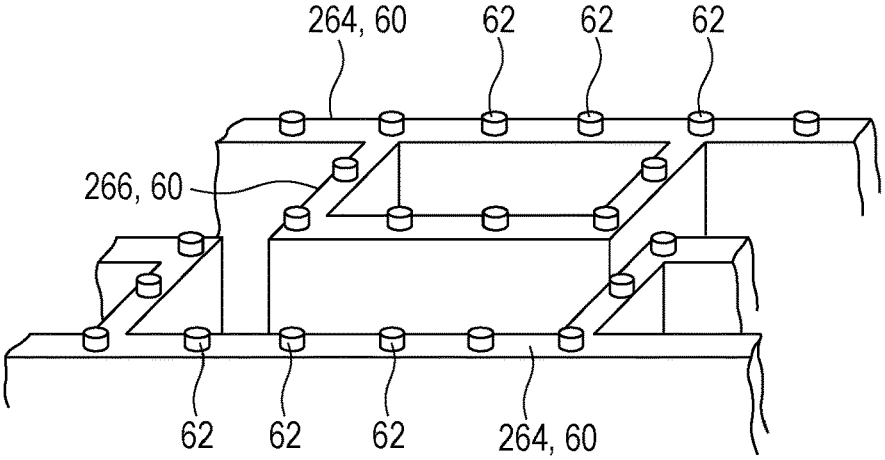
FIG. 7 is an enlarged perspective view of an area VII in FIG. 6.

FIG. 7 is an enlarged perspective view of an area VII in FIG. 6. In the wall portion 60 (which is the frame-shaped portion 264 and the partitioning portion 266) of the case member 26, a plurality of protrusion portions 62 are formed in an end surface facing the fixing plate 22, as illustrated in FIGS. 5 and 7. Each protrusion portion 62 is a portion protruding from the end surface of the wall portion 60 to the fixing plate 22 side (which is the positive side in the Z direction). The protrusion portions 62 are formed at positions spaced apart from each other. Specifically, in the wall portion 60, the protrusion portions 62 are formed at positions of intersection points between a portion extending in the X direction and a portion extending in the Y direction. In addition, the protrusion portions 62 are formed at positions at which the length between the intersection points is equally divided. The plurality of protrusion portions 62 are dispersed in the X-Y plane such that the protrusion portions 62 are substantially-uniformly distributed in a plan view. Although the protrusion portion 62 having a cylindrical shape is exemplified in FIG. 7, the protrusion portion 62 can have any shape. The end surface of the wall portion 60 of the case member 26 is bonded to the second surface 224 of the fixing plate 22, in a state where each protrusion portion 62 is in contact with the second surface 224 of the fixing plate 22, as can be understood from FIG. 5.

The plurality of head units 24 which are fixed to both the fixing plate 22 and the case member 26 using an adhesive are accommodated in the accommodation space S of the case member 26 which is fixed to the fixing plate 22 via the adhesive 74, as described above. When the fixing plate 22, the case member 26, and each head unit 24 are fixed to one another, the size of the gap D between the second surface 224 of the fixing plate 22 and the facing portion 262 (which is the bottom surface of the accommodation space S) of the case member 26 is greater than the height (which is the distance between the second surface 224 and the surface of the casing body 40) H of the head unit 24, relative to the second surface 224, as can be understood from FIG. 5. Accordingly, a substantially constant gap is formed in a portion between the surface of the casing body 40 of the head unit 24 and the facing portion 262 of the case member 26. The configuration described above has an advantage in that, even when error is caused in the heights H of the head units 24, the case member 26 can be reliably fixed to the second surface 224 of the fixing plate 22.

Manufacturing Method of Liquid Ejecting Head 16

Figure 8:
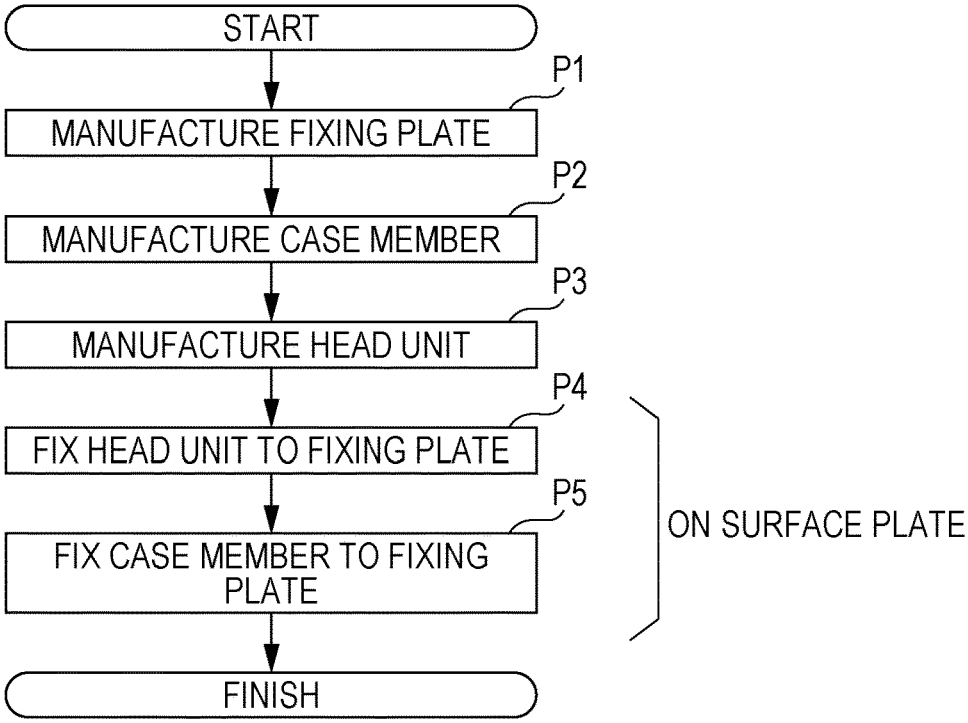
FIG. 8 is a flow chart of a manufacturing method of the liquid ejecting head.

The manufacturing method of the liquid ejecting head 16 described above will be described. FIG. 8 is a flow chart of the manufacturing method of the liquid ejecting head 16.

Figure 9:
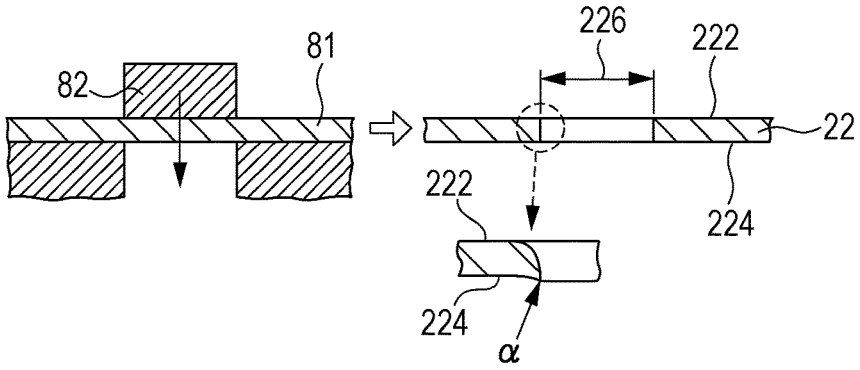
FIG. 9 is an explanatory view of manufacturing (punching) of a fixing plate.

First, the fixing plate 22 is prepared in a process P1, as illustrated in FIG. 8. Punching is suitable for manufacturing the fixing plate 22. In other words, an area of a plate material 81 formed of, for example, stainless steel, which is a portion corresponding to each opening portion 226 of the fixing plate 22, is subjected to punching using a punching mold 82, as illustrated in FIG. 9. As a result, the fixing plate 22 having the plurality of opening portions 226 formed therein is manufactured. Upon comparison with a case where the opening portion 226 is formed by, for example, cutting the plate material 81, punching has an advantage in that the opening portion 226 can be formed while maintaining the flatness of the fixing plate 22.

When the opening portion 226 is formed by the punching mold 82, as described above, a part of the fixing plate 22, which is a portion in the vicinity of the inner circumferential edge of the opening portion 226, in the surface on an upstream side in a proceeding direction of the punching mold 82, is a continuous curved surface, as illustrated in the enlarged view of the FIG. 9. However, a corner portion α can be formed in the inner circumferential edge of the opening portion 226, in the surface on a downstream side in the proceeding direction of the punching mold 82. In Embodiment 1, the surface (that is, the surface of which a portion in the vicinity of the inner circumferential edge of the opening portion 226 is a curved surface) of the fixing plate 22, which is the surface on the upstream side in the proceeding direction of the punching mold 82, is selected as the first surface 222.

Figure 10:
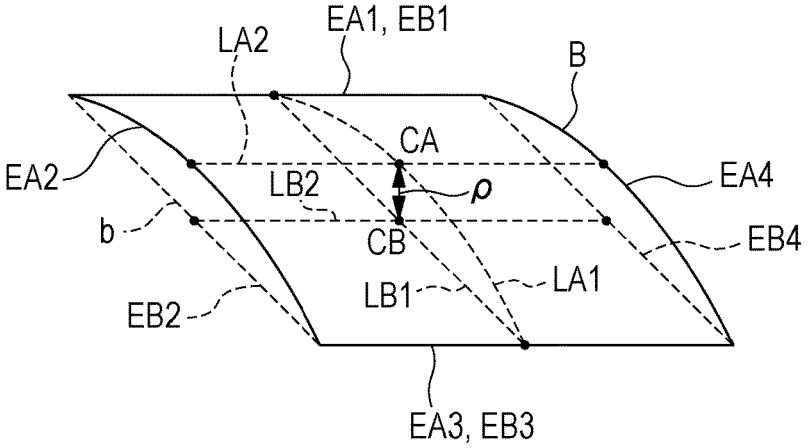
FIG. 10 is an explanatory view of a definition of flatness.

The flatness (that is, the degree of flatness) ρ of the fixing plate 22 manufactured in the process P1 is, for example, about 150 μm. The flatness ρ is an indicator of the degree (the degree of deviation from a plane) of flatness of a plate-shaped member. FIG. 10 is an explanatory view of the flatness ρ of a plate-shaped member B (for example, the fixing plate 22) of which the surface shape is rectangular. The focus will be placed on an intersection point CA and an intersection point CB, as can be understood from FIG. 10. The intersection point CA is an intersection point between a line LA1 and a line LA2. The line LA1 connects mid-points of a pair of opposite sides (EA1 and EA3) of edge sides of the plate-shaped member B, in the surface (curved surface) of the plate-shaped member B. The line LA2 connects mid-points of a pair of the other opposite sides (EA2 and EA4), in the surface of the plate-shaped member B. Meanwhile, the intersection point CB is a point in an imaginary rectangle b including four vertices of the plate-shaped member B. Specifically, the intersection point CB is an intersection point between a line LB1 and a line LB2. LB1 connects mid-points of a pair of opposite sides (EB1 and EB3) of edge sides of the rectangle b, in the same plane as the rectangle b. LB2 connects mid-points of a pair of the other opposite sides (EB2 and EB4), in the same plane as the rectangle b. The flatness ρ is defined as the distance between the intersection point CA and the intersection point CB described above. Accordingly, it can be evaluated that the smaller the flatness ρ of the plate-shaped member B is, the closer the plate-shaped member B is to an ideal plane (that is, the imaginary rectangle b).

Figure 11:
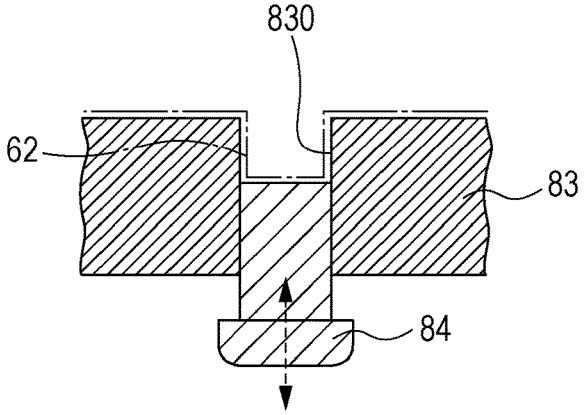
FIG. 11 is an explanatory view of a mold used for forming the case member.

The case member 26 is prepared in a process P2 of FIG. 8. Injection molding using a mold is suitable for manufacturing the case member 26. FIG. 11 is a cross-sectional view of a part of the mold used in the process P2, which is the portion used for forming each protrusion portion 62. A through-hole 830 corresponding to the protrusion portion 62 is formed in a mold 83 and a screw 84 of which the tip portion is molded to have a flat surface is inserted into the through-hole 830, as illustrated in FIG. 11. The height of the protrusion portion 62 can be separately adjusted in such a manner that the position of the tip portion is adjusted by rotating the screw 84. In the process P2, the case member 26 including the facing portion 262, the frame-shaped portion 264, the plurality of partitioning portions 266, and the plurality of protrusion portions 62 is integrally molded using the mold 83 in which the position of each screw 84 is adjusted such that tip surfaces (that is, top surfaces) of the plurality of protrusion portions 62 are located in the same plane. Accordingly, Embodiment 1 has an advantage in that the case member 26 having uniform heights for the plurality of the protrusion portions 62 can be manufactured at low manufacturing costs, compared to in a case where the respective elements of the case member 26 are separately formed.

Error due to expansion/contraction of resin material in processing is caused in injection molding. Thus, practically, it is difficult to uniformize the height of the entirety of the end surface of the wall portion 60 of the case member 26 with high accuracy. In contrast, uniformizing the heights of the plurality of protrusion portions 62 formed on the end surface of the wall portion 60, as described in Embodiment 1, can be easily performed, compared to uniformizing the height of the entirety of the wall portion 60. Specifically, the flatness ρ of the plurality of protrusion portions 62 of Embodiment 1 is within the range of, for example, 30 μm to 60 μm. In other words, the flatness ρ of the plurality of protrusion portions 62 is less than the flatness ρ (150 μm) of the fixing plate 22 itself (in other words, the flatness ρ in a state where the fixing plate 22 is not fixed to the case member 26). The flatness ρ of the plurality of protrusion portions 62 is calculated by the same method described with FIG. 10, on the assumption that the plane passing through the protrusion portions 62 is an imaginary plate-shaped member B.

The plurality of head units 24 are prepared in a process P3 of FIG. 8. A known technology is used for manufacturing the head units 24. The order from the process P1 to the process P3 described above can be changed.

Figure 12:
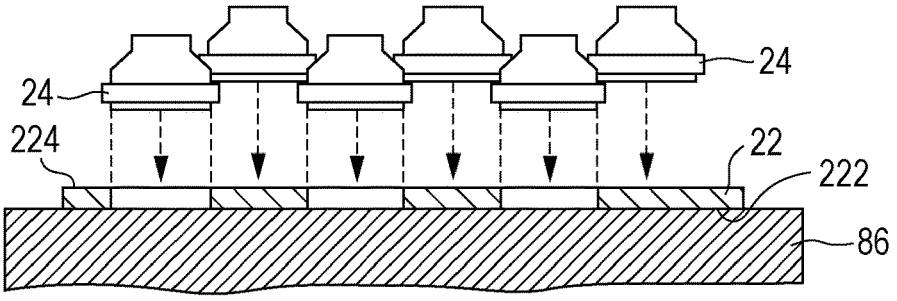
FIG. 12 is an explanatory view of processes for fixing a plurality of the head units to the fixing plate.

When the fixing plate 22, the plurality of head units 24, and the case member 26 are prepared in the processes described above, the plurality of the head units 24 are fixed to the fixing plate 22 (process P4). Specifically, the fixing plate 22 is mounted on a surface plate 86, in a state where the second surface 224 is directed upward (that is, the first surface 222 is located on the surface plate 86 side), as illustrated in FIG. 12. Then, the plurality of head units 24 are fixed, using, for example, an adhesive, to the second surface 224 of the fixing plate 22 on the surface plate 86, in a state where the nozzle plate 42 of each head unit 24 is located in the inner side of each opening portion 226 of the fixing plate 22. The height h of a part of the nozzle plate 42 of the head unit 24, which is a portion protruding from the second surface 224 to the first surface 222 side, is less than the thickness TB of the fixing plate 22, as described above. Thus, when the head unit 24 is fixed to the fixing plate 22, the surface of the nozzle plate 42 is not in contact with the surface of the surface plate 86. As a result, the fixing plate 22 is prevented from floating from the surface plate 86.

Figure 13:
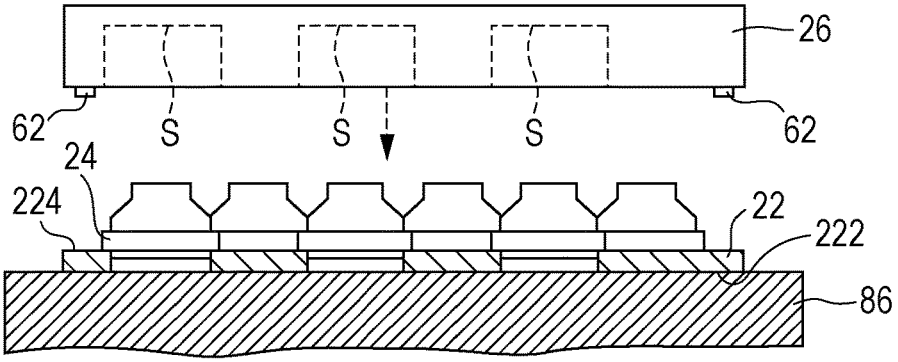
FIG. 13 is an explanatory view of processes for fixing the case member to the fixing plate.

In a process P5 following the process P4, the case member 26 is fixed, using, for example, the adhesive 74, to the second surface 224 of the fixing plate 22 while maintaining the state of the process P4, in which the fixing plate 22 is mounted on the surface plate 86, as illustrated in FIG. 13. Specifically, the case member 26 is fixed to the fixing plate 22 on the surface plate 86, in a state where the wall portion 60 of the case member 26 surrounds the respective head units 24 on the fixing plate 22 (that is, the respective head units 24 are accommodated in the accommodation space S) and the plurality of protrusion portions 62 of the wall portion 60 are in contact with the second surface 224 of the fixing plate 22. In the process P5, the adhesive 72 is applied to the surface of the casing body 40 of each head unit 24 so as to surround the liquid flow path 406. Accordingly, the case member 26 is fixed to the fixing plate 22 and the respective head units 24 are bonded to the case member 26 (the facing portion 262). The liquid ejecting head 16 is manufactured by the processes described above. The process P4 of FIG. 8 exemplifies a first process and the process P5 exemplifies a second process.

Since the flatness ρ of the plurality of protrusion portions 62 is reduced to an adequately small value (that is, the heights of the plurality of the protrusion portions 62 are uniformized with high accuracy), as described above, the fixing plate 22 which is fixed to the case member 26 in a state where the plurality of protrusion portions 62 are in contact with the fixing plate 22 is flattened, compared to in the case of the fixing plate 22 itself. Specifically, the flatness ρ of the fixing plate 22 itself is about 150 μm, as described above. In contrast, the flatness ρ of the fixing plate 22 in a state where the fixing plate 22 is fixed to the case member 26 is within the range of 40 μm to 70 μm. The plurality of protrusion portions 62 of the case member 26 act to flatten the fixing plate 22, as can be understood from the above description.

In Embodiment 1, the plurality of head units 24 are fixed to the second surface 224 of the fixing plate 22 and the plurality of protrusion portions 62 are formed in a part of the wall portion 60 of the case member 26, which is a portion (the top surface) facing the fixing plate 22, as described above. It is relatively easy to uniformize the heights of the plurality of protrusion portions 62 with high accuracy, as described above. Thus, the fixing plate 22 in Embodiment 1 is flattened, compared to the configuration (that is, the configuration in which a part of the wall portion 60, which is the entirety of the surface facing the fixing plate 22, is in contact with the second surface 224 of the fixing plate 22) in which the protrusion portions 62 are not formed in the wall portion 60. In other words, it is possible to highly flatten the fixing plate 22, without using an expensive material capable of achieving adequate flatness by itself. Accordingly, there is an advantage in that it is possible to reduce the differences in the distance (the ejection distance) between the surface (the ejection surface) of the nozzle plate 42 of each head unit 24 and the printing medium 200 while reducing the manufacturing costs.

In Embodiment 1, the plurality of head units 24 and the case member 26 are fixed to the fixing plate 22, using an adhesive. Thus, the deformation of the fixing plate 22 is suppressed, compared to the configuration in which the head units 24 and the case member 26 are fixed to the fixing plate 22, using, for example, a screw. Accordingly, the above-described effect that the fixing plate 22 can be highly flattened is especially remarkable. In addition, there is an advantage in that it is easy to assemble the liquid ejecting head 16, compared to the configuration in which a screw or the like is used.

Figure 14:
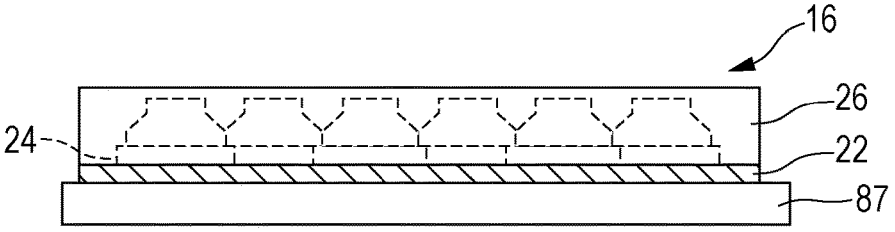
FIG. 14 is an explanatory view of a suction operation using a cap.

Meanwhile, in the printing apparatus 100, a suction operation for forcibly discharging the ink through the respective nozzles N is performed for cleaning the respective nozzles N, in such a manner that negative pressure is generated in a cap sealing the respective nozzles N, In Embodiment 1, the nozzles N of the plurality of head units 24 are sealed, all together, by a cap 87 which itself comes into contact with the entire area of the first surface 222 of the fixing plate 22, as illustrated in FIG. 14. Accordingly, there is an advantage in that the configuration is simplified (for example, the number of parts is reduced), compared to the configuration in which caps are separately mounted for the respective head units 24. Furthermore, since the fixing plate 22 in the Embodiment 1 is highly flattened, as described above, there is an advantage in that the nozzles N can be effectively sealed over the plurality of head units 24, regardless of the configuration in which the single cap 87 is mounted on the plurality of head units 24.

In Embodiment 1, the flow-path forming plate 32 and the pressure chamber forming plate 34 of the head unit 24 are formed of silicon and the fixing plate 22 is formed of SUS430 stainless steel, which has the linear expansion coefficient similar to that of silicon. Accordingly, there is an advantage in that it is possible to reduce the thermal stress which can be caused in the head unit 24 or the fixing plate 22 due to the difference in the linear expansion coefficients, compared to the configuration in which the elements of the head unit 24 and the fixing plate 22 have different linear expansion coefficients.

In Embodiment 1, the respective opening portions 226 of the fixing plate 22 are formed through punching using the punching mold 82, and the surface of the fixing plate 22, which is the surface on the upstream side in the proceeding direction of the punching mold 82, is selected as the first surface 222. In other words, the corner portion α formed on the downstream side in the proceeding direction of the punching mold 82 is located on the head unit 24 side. Accordingly, there is an advantage in that an external element (which is a wiper in the following description) is prevented from being damaged due to impact of the external element against the corner portion α of the fixing plate 22, as described below.

In the printing apparatus 100, a cleaning operation for the nozzle plate 42 is performed using a wiper. Specifically, the surface of the nozzle plate 42 is cleaned in such a manner that a wiper 88 formed of an elastic material is relatively moved over both the first surface 222 of the fixing plate 22 and the nozzle plate 42, as illustrated by the chain line in FIG. 5. In the configuration in which the surface of the plate material 81, which is the surface having the corner portion α formed therein due to punching, is set to the first surface 222 of the fixing plate 22, there is a possibility that the wiper 88 moving in a state where the wiper 88 is in contact with the first surface 222 may be damaged due to the impact of the wiper 88 against the corner portion α. In Embodiment 1, the surface of the plate material 81, which is the surface having the corner portion α formed thereon, is located on the head unit 24 side, as the second surface 224 of the fixing plate 22, as described using FIG. 9. Thus, the impact of the wiper 88 against the corner portion α is prevented. As a result, Embodiment 1 has an advantage in that damage to the wiper 88 can be prevented.

Embodiment 2

Hereinafter, Embodiment 2 of the invention will be described. The same reference numerals as those in the description of Embodiment 1 are given to elements of the configurations described below, which perform the same operations/functions as those in Embodiment 1. The detailed descriptions of these elements will not be appropriately repeated.

Figure 15:
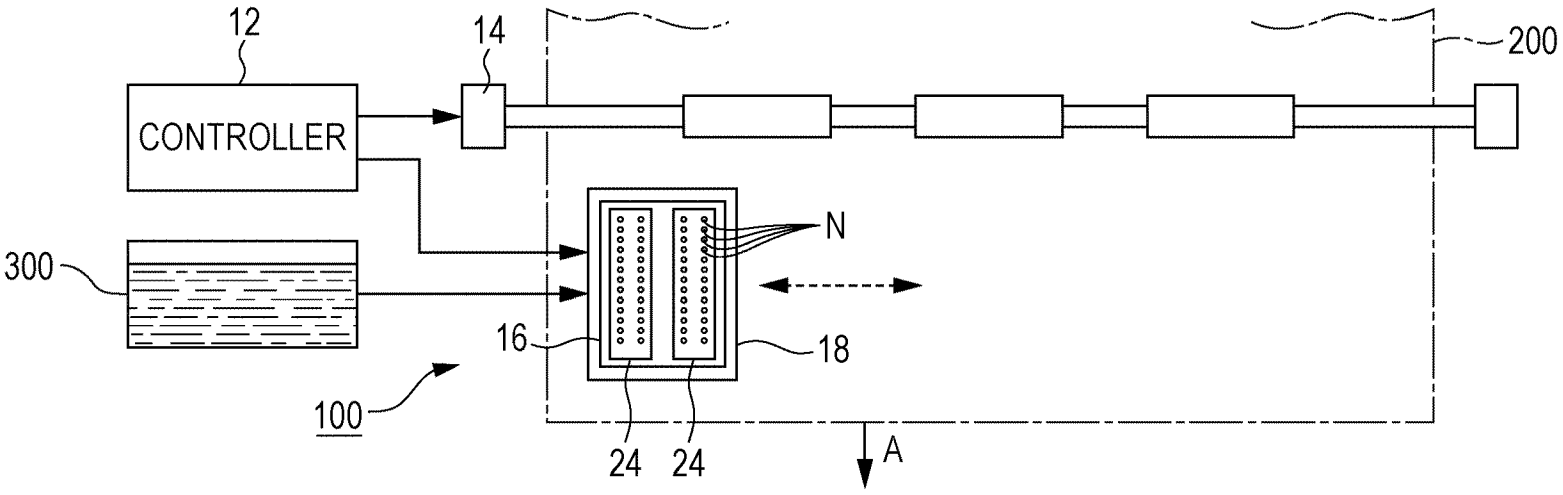
FIG. 15 is a configuration view of a printing apparatus according to Embodiment 2.
Figure 16:
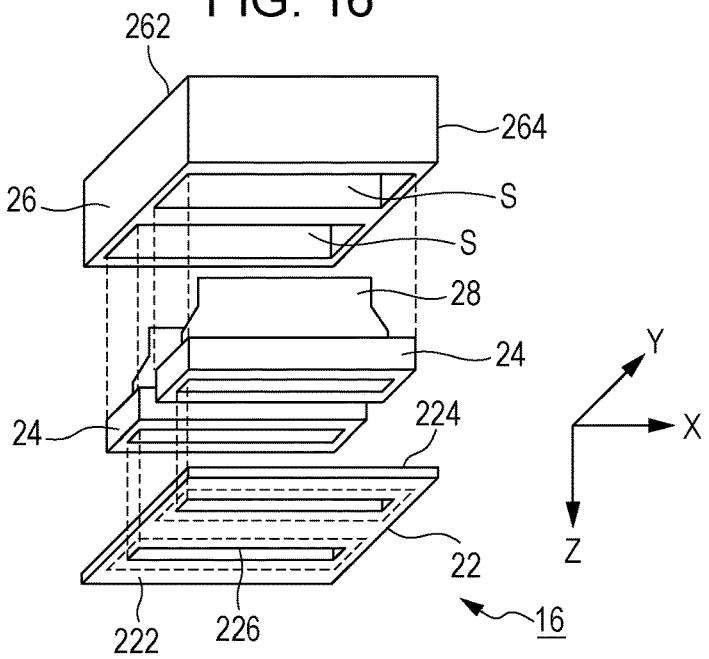
FIG. 16 is an exploded perspective view of a liquid ejecting head of Embodiment 2.

FIG. 15 is a partial configuration view of the printing apparatus 100 according to Embodiment 2. The liquid ejecting head 16 of the printing apparatus 100 of Embodiment 2 is a serial head mounted on a carriage 18. The liquid ejecting head 16 includes the fixing plate 22, the plurality (two in the example illustrated in FIG. 15) of head units 24, and the case member 26, as illustrated in FIG. 16.

Similarly to Embodiment 1, each of the plurality of the head units 24 is fixed to the second surface 224 of the fixing plate 22 and is accommodated in the accommodation space S formed by the wall portion 60 (the frame-shaped portion 264) of the case member 26. In a plan view, the wall portion 60 of Embodiment 2 surrounds the head unit 24 over the entire circumference, as can be understood from FIG. 16. A plurality of protrusion portions (not illustrated in FIG. 16) which come into contact with the second surface 224 of the fixing plate 22 are formed on an end surface of the wall portion 60, which faces the fixing plate 22. The liquid ejecting head 16 is mounted on the carriage 18, in a state where an arrangement direction (that is, the X direction) of the plurality of nozzles N of each head unit 24 is directed in the direction A in which the printing medium 200 is transported, as illustrated in FIG. 15. The carriage 18 reciprocates in a direction intersecting with the direction A in which the printing medium 200 is transported. The carriage 18 reciprocates and the ink is ejected onto the printing medium 200 through the nozzles N of each head unit 24. The same effects as those in Embodiment 1 are achieved in Embodiment 2.

Modification Example

The embodiments described above can be modified in various ways. Specific modification aspects will be described below. Two aspects or more which are arbitrarily selected from the examples described below can be appropriately used in combination as long as they do not conflict with each other.

Figure 17:
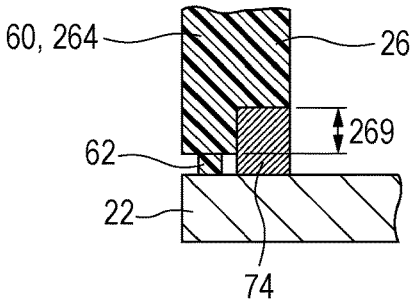
FIG. 17 is a cross-sectional view of a wall portion and a fixing plate of a modification example.

(1) The shapes of the wall portion 60 of the case member 26 and each protrusion portion 62 are not limited to the examples described above. The adhesive 74 can be applied to, for example, a concave portion 269 formed in a part of the end surface of the frame-shaped portion 264 (that is, the wall portion 60) of the case member 26, which is a portion on the inner circumferential edge side, as illustrated in FIG. 17. The plurality of protrusion portions 62 are formed in a part of the end surface of the frame-shaped portion 264, which is an area other than the concave portion 269. According to the configuration of FIG. 17, the adhesive 74 is applied to the inner portion of the concave portion 269. Thus, there is an advantage in that it is possible to reduce the possibility that the remainder of the adhesive 74 may flow outside the frame-shaped portion 264.

Figure 18:
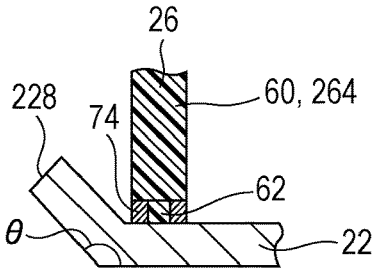
FIG. 18 is a cross-sectional view of a wall portion and a fixing plate of a modification example.

(2) The fixing plate 22 in a plate shape not having a bent portion is exemplified in the embodiments described above. The configuration in which the fixing plate 22 is partially bent can be applied. For example, the configuration in which a portion 228 which is a part of the fixing plate 22 protruding from the frame-shaped portion 264 of the case member 26 is bent to the case member 26 side by a predetermined bending angle θ is preferable, as illustrated in FIG. 18. The bending angle θ is an angle between one side of the fixing plate 22 and the other side while interposing the boundary line of the bent portion. According to the configuration of FIG. 18, there is an advantage in that the flowing of the remainder of the adhesive 74 bonding the case member 26 and the fixing plate 22 can be prevented by the bent portion 228 of the fixing plate 22.

When the bending angle θ of the fixing plate 22 is excessively small (for example, when the bending angle θ is an acute angle), there is a possibility that the flatness of the fixing plate 22 may be deteriorated during a bending process (that is, an increase in the value of flatness ρ). Thus, the configuration in which the bending angle θ is within the range of an obtuse angle)($90° < \theta < 180°$) is preferred in terms of achieving the high flatness of the fixing plate 22. In other words, it is possible to say that the bending angle θ of the fixing plate 22 in the plate shape exemplified in the above embodiments is 180° (that is, the fixing plate 22 does not have a bent portion).

(3) In the embodiments described above, the fixing plate 22 is formed by performing punching on the plate material 81. However, the forming method of each opening portion 226 is not limited to punching. The fixing plate 22 can be formed in such a manner that parts of the plate material 81, which correspond to the respective opening portions 226, are removed by, for example, etching. When etching is applied to form the fixing plate 22, it is not necessary to apply an external force to the plate material 81, in the process P1 for forming the fixing plate 22. As a result, the effect that the fixing plate 22 is highly flattened is especially remarkable.

Figure 19:
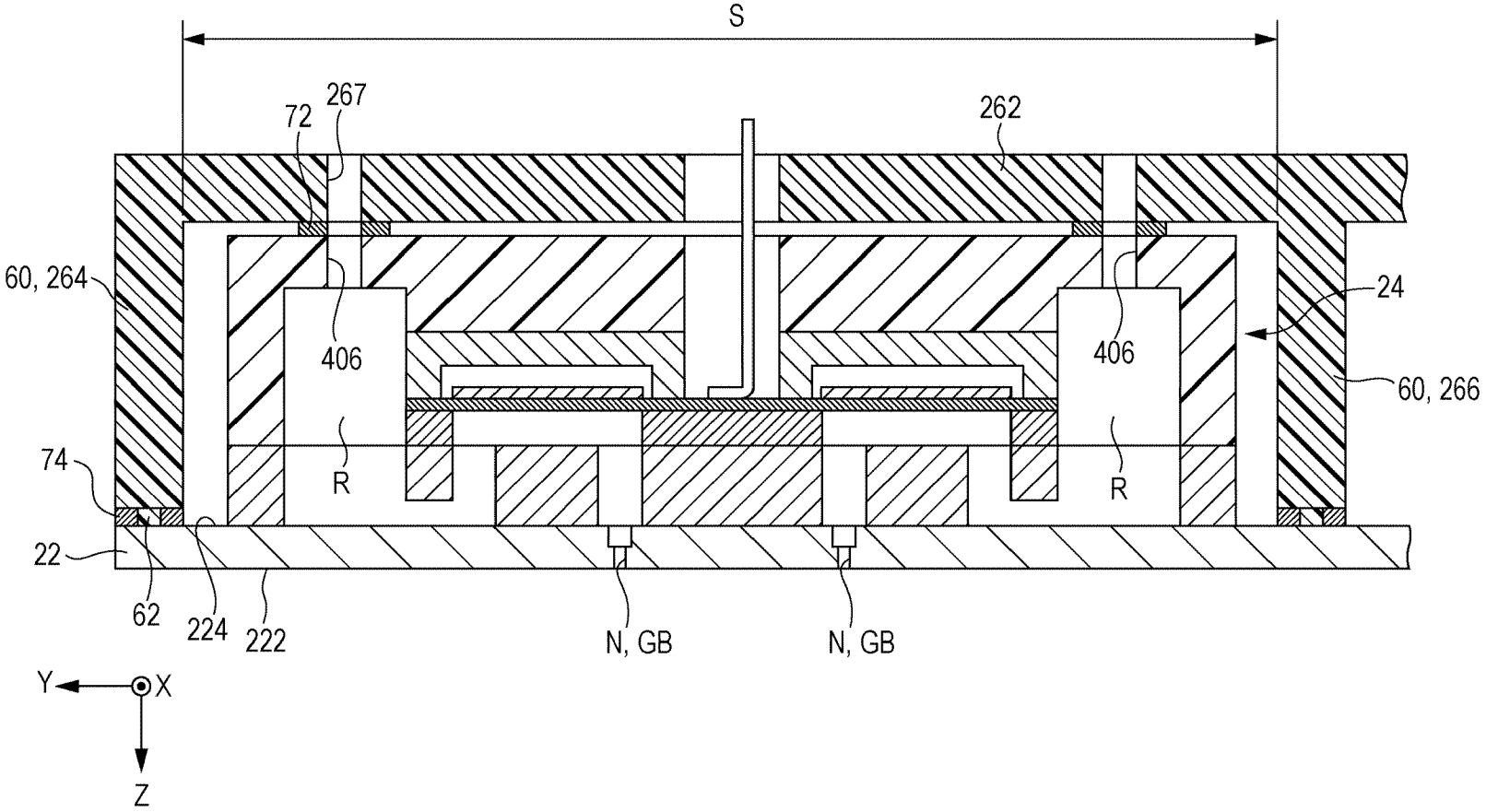
FIG. 19 is a cross-sectional view of a liquid ejecting head of a modification example.

(4) In the embodiments described above, the nozzle plate 42 separate from the fixing plate 22 is installed in each head unit 24. However, the fixing plate 22 can be also used as the nozzle plate 42. For example, the configuration in which the second surface 224 of the fixing plate 22 is bonded, using, for example, an adhesive, to a surface of the flow-path forming plate 32, which is the surface on a side opposite to the pressure chamber forming plate 34, and the nozzles N communicating with the respective communication flow paths 326 of the flow-path forming plate 32 are formed in the fixing plate 22 may be applied, as illustrated in FIG. 19. In the configuration of FIG. 19, there is an advantage in that the configuration of the head unit 24 is simplified (for example, the number of parts is reduced) because the nozzle plate 42 exemplified in the above-described embodiments is omitted. The plurality of head units 24 are fixed to the second surface 224 of the fixing plate 22 such that the ink can be ejected to the first surface 222 side of the fixing plate 22, as can be understood from FIGS. 5 and 19. The nozzle plate 42 can be provided or not provided.

(5) An element (a pressure generation element) for changing the pressure in the pressure chamber C is not limited to the piezoelectric element 362. An oscillation body, such as an electrostatic actuator, for example, can be used as a pressure generation element. Furthermore, the pressure generation element is not limited to an element which applies mechanical oscillation to the pressure chamber C. A heating element (a heater) which changes the pressure in the pressure chamber C in such a manner that the heating element generates air-bubbles in the pressure chamber C by heating can be used as the pressure generation element. In other words, the pressure generation element comprehensively includes elements for changing the pressure in the pressure chamber C. Any type (piezo type/thermal type) for changing pressure and any specific configuration can be applied.

(6) The printing apparatus 100 exemplified in the above embodiments can be applied to various apparatuses, such as a facsimile or a copy machine, in addition to an apparatus dedicated to printing. The use of the liquid ejecting apparatus of the invention is not limited to printing. A liquid ejecting apparatus which ejects solutions of coloring material may be used as, for example, a manufacturing apparatus for forming a color filter of a liquid crystal display device. A liquid ejecting apparatus which ejects solutions of conductive material may be used as a manufacturing apparatus for forming wiring or an electrode of a wiring substrate.

What is claimed is:

1. A liquid ejecting head comprising:

a plurality of head units each comprising a nozzle plate and configured to eject liquid;

a plate comprising holes for each head unit of the plurality of head units; and a case fixed to the plate, comprising accommodations for the head units formed by a plurality of wall portions, a plurality of projections extend from the plurality of wall portions and define a plane flatter than the plate to be fixed to the case.

2. The liquid ejecting head according to claim 1, wherein the case keeps the fixed plate flat.

3. The liquid ejecting head according to claim 1, wherein the head units and the case are fixed to the plate by an adhesive.

4. The liquid ejecting head according to claim 1, wherein the plate lids the case.

5. The liquid ejecting head according to claim 1, wherein the case is integrally molded by a resin material.

6. The liquid ejecting head according to claim 1, wherein the plate is made of stainless steel.

7. The liquid ejecting head according to claim 6, wherein the plate is obtusely bent.

8. The liquid ejecting head according to claim 6, wherein the head unit comprises a substrate made of silicon, and wherein the type of the stainless steel is SUS430.

9. The liquid ejecting head according to claim 1, wherein the holes are formed by performing punching or etching on a plate material.

10. A liquid ejecting apparatus comprising:

the liquid ejecting head according to claim 1.

11. A manufacturing method of a liquid ejecting head including a plate, a plurality of head units which eject liquid, and a case which includes accommodations for the head units, the accommodations formed from a plurality of wall portions, a plurality of projections extend from the plurality of wall portions, the method comprising:

putting the plate into contact with the plurality of projections defining a plane flatter than the plate in a state where the head units are accommodated in the case; and fixing the plate and the case.

12. The manufacturing method according to claim 11, wherein the case keeps the fixed plate flat.

13. The manufacturing method according to claim 11, wherein the head units and the case are fixed to the plate by an adhesive.

14. The manufacturing method according to claim 11, wherein the plate lids the case.

15. The manufacturing method according to claim 11, wherein the case is integrally molded by a resin material.

16. The manufacturing method according to claim 11, wherein the plate is made of stainless steel.

17. The manufacturing method according to claim 16, wherein the plate is obtusely bent.

18. The manufacturing method according to claim 16, wherein the head unit comprises a substrate made of silicon, and wherein the type of the stainless steel is SUS430.

19. The manufacturing method according to claim 11, wherein the holes are formed by performing punching or etching on a plate material.

* * * * *